United States Patent [19]

Couper et al.

[11] 4,341,614

[45] Jul. 27, 1982

[54] PRODUCTION OF POROUS DIAPHRAGMS

[75] Inventors: Aitken M. Couper; Stuart F. Mellish, both of Runcorn, England

[73] Assignee: Imperial Chemical Industries Limited, London, England

[21] Appl. No.: 955,603

[22] Filed: Oct. 30, 1978

[30] Foreign Application Priority Data

Nov. 15, 1977 [GB] United Kingdom ..... 47442/77

[51] Int. Cl.[3] ..... C25B 13/04; C25B 13/08

[52] U.S. Cl. ..... 204/296

[58] Field of Search ..... 204/296

[56] References Cited

U.S. PATENT DOCUMENTS 3,930,979 1/1976 Vallance ..... 204/252

4,003,818 1/1977 Juillard et al. ..... 204/296

FOREIGN PATENT DOCUMENTS 1491033 6/1967 France ..... 204/296

48-20780 3/1973 Japan ..... 204/296

OTHER PUBLICATIONS

Hackh's Chem. Dict., 3rd Ed. by Grant, p. 262, Pub. by Blakiston, Philadelphia.

*Primary Examiner*—F. Edmundson

*Attorney, Agent, or Firm*—Cushman, Darby & Cushman

[57] ABSTRACT

A method of manufacturing a porous diaphragm of an organic polymeric mateial, e.g. of polytetrafluoroethylene, suitable for use as a diaphragm in an electrolytic cell, the method comprising forming a sheet of organic polymeric material containing particulate dextrin, for example by heating a starch-containing sheet, optionally in the presence of acid, to convert the starch in the sheet to dextrin, and extracting the dextrin from the sheet, for example by contacting the sheet with caustic alkali and/or with alkali metal hypochlorite.

6 Claims, No Drawings

PRODUCTION OF POROUS DIAPHRAGMS

This invention relates to a method of manufacturing a porous diaphragm for use in an electrolytic cell of the type comprising an anode and cathode separated by a diaphragm, and in particular to a method of manufacturing such a diaphragm for use in an electrolytic cell for the production of chlorine and caustic alkali by the electrolysis of an aqueous alkali metal chloride solution. More particularly the invention relates to a method of manufacturing a porous diaphragm based on a synthetic organic polymeric material, especially a fluorine-containing polymer, e.g. polytetrafluoroethylene, as fluorine-containing polymers are particularly resistant to degradation by chlorine and caustic alkali and are thus especially suitable for use in such a cell.

In the specification of our U.K. Pat. No. 1,081,046 there is described a method of manufacturing a porous diaphragm which method comprises forming an aqueous slurry or dispersion of polytetrafluoroethylene and a solid particulate additive, e.g. starch, adding an organic coagulating agent, e.g. acetone, to said dispersion and then drying the coagulated dispersion. An organic lubricant, e.g. petroleum ether, is then added to the dried coagulated material to serve as a processing aid when the material is passed between rollers in order to convert the material into the form of a sheet. On completion of the sheet-forming operation the solid particulate material, e.g. starch, is removed from the sheet to give the desired porous diaphragm. The lubricant may also be removed if required.

An improved method of manufacturing a porous diaphragm in which the organic lubricant is replaced by water as the lubricant is described in the specification of our U.K. Pat. No. 1,424,804. This improved method comprises preparing an aqueous slurry or dispersion of polytetrafluoroethylene and a solid particulate additive, e.g. starch, thickening the aqueous slurry or dispersion to effect agglomeration of the solid particles in the dispersion, forming from the thickened slurry or dispersion a dough-like material containing sufficient water to serve as lubricant in a subsequent sheet-forming operation, forming a sheet of desired thickness from the dough-like material, and removing the solid particulate additive, e.g. starch, from the sheet.

In each of the above-described methods the solid particulate additive is removed from the sheet prior to introducing the resultant porous diaphragm into the cell, the method of removal which is used being of course dependent on the nature of the particulate additive in the sheet. For example, where the particulate additive in starch the additive may be removed by soaking the sheet in caustic soda solution. The diaphragm is then washed with water to remove the caustic soda and mounted, whilst wet, into an electrolytic cell. It is necessary to keep the diaphragm wet during mounting in order to prevent collapse of the pores in the diaphragm and this leads to considerable difficulties in handling since the diaphragm is both extremely wet and extremely slippery.

Further disadvantages arising from the use of pre-extracted diaphragms, prepared as described above, include the difficulty of ensuring adequate tautness of the wet diaphragm during mounting in the electrolytic cell, and the possibility of leakages occurring at the edges of the diaphragm where the diaphragm is sealed to the cell structure.

In the specification of our U.K. Pat. No. 1,468,355 we have described a process for extracting a solid particulate additive, e.g. starch, from a sheet of a synthetic organic polymeric material in which the above mentioned disadvantages are obviated or mitigated. In this latter process the sheet of synthetic organic polymeric material containing the solid particulate additive is introduced into an electrolytic cell and the additive is removed from the sheet in situ in the cell thus avoiding the disadvantages of handling the wet and slippery diaphragm. For example, the particulate additive may be removed from the sheet by filling the cell with an electrolyte, e.g. an alkali metal chloride solution, and applying a current to electrolyse the solution.

Although the above described processes provide useful methods for the manufacture of porous diaphragms we have found that where the solid particulate additive which is removed from the sheet of synthetic organic polymeric material is starch, the methods suffer from disadvantages. Thus, where the starch is extracted by soaking the sheet in caustic soda solution, and especially where the starch is removed from the sheet in situ in the electrolytic cell by filling the cell with alkali metal chloride solution and applying a current to electrolyse the solution, the starch swells substantially and disrupts the carefully fabricated structure of the sheet. Where the starch is removed electrolytically a substantial amount of heat is generated which is difficult to remove from the electrolytic cell due to the slow attainment of permeability in the sheet.

We have now found a method of manufacturing a porous diaphragm in which the above mentioned disadvantages are obviated or mitigated. Furthermore, the method results in production of a diaphragm which exhibits a smaller variation in permeability during use in an electrolytic cell than is the case with diaphragms produced by the aforementioned methods.

According to the present invention there is provided a method of manufacturing a porous diaphragm of an organic polymeric material suitable for use as a diaphragm in an electrolytic cell which method comprises forming a sheet of organic polymeric material containing particulate dextrin and extracting the dextrin from the sheet.

The porous diaphragm produced by the process of the invention is particularly suitable for use in an electrolytic cell for the production of chlorine and caustic alkali by the electrolysis of an aqueous alkali metal chloride solution. It may, however, be used in other types of electrolytic cells.

The method of the invention is particularly suitable for the production of porous diaphragms from fluorine-containing organic polymeric materials, for example from polymers or copolymers of vinyl fluoride, vinylidene fluoride, tetrafluoroethylene, hexafluoropropylene, and particularly from polytetrafluoroethylene.

The sheet, which suitably has a thickness in the range 0.5 to 5 mm, e.g. 1 to 3 mm, may be formed by the methods generally described in the aforementioned U.K. Patent Specifications, particularly that described in the specification of U.K. Pat. No. 1,424,804. For example, it may be formed from a mixture of particulate organic polymeric material, e.g. from an aqueous slurry or dispersion of the organic polymeric material, and particulate dextrin of a suitable particle size, for example by a process of calendering the mixture between rollers. The dextrin, which is a thermally modified starch, may itself be formed from starch by known methods, for example by heating starch or by contacting starch with dilute acid and subsequently heating the starch. Heating at a temperature in the range 70° C. to 220° C. is generally suitable.

Alternatively, the sheet may be formed from a mixture of organic polymeric material and particulate starch and the starch in the sheet, or at least a substantial amount of the starch in the sheet, may subsequently be converted to dextrin. This latter method is preferred as we find that where starch has been converted to dextrin in the sheet there is less swelling of the sheet on subsequent extraction than is the case where the sheet has been formed from dextrin and organic polymeric material.

The starch may suitably be potato starch or maize starch or a mixture thereof.

Conversion of the starch to dextrin in situ in the sheet of organic polymeric material may be effected by heating the sheet. Where heat alone is used to convert the starch to dextrin the temperature that may be required may be so high, e.g. up to 200° C. or even higher, and the heating time, e.g. 120 hours or greater, so long that some charring of the starch may occur unless care is taken and it is preferred that the conversion of starch to dextrin is catalysed by contacting the sheet with acid. For example, the sheet may be contacted with dilute acid, e.g. by immersing the sheet in 1% aqueous HCl for 10 minutes, and the sheet may subsequently be heated to convert the starch to dextrin. The heating time required may suitably be in the range 2 hours to 150 hours or even longer. Use of acid catalysts enable temperatures and/or times at the lower ends of these ranges to be used.

Where the sheet is made from a particulate organic polymeric material, and especially where the material is a fluorine-containing polymer, e.g. polytetrafluoroethylene, a preferred particle size of the polymeric material is in the range 0.05 to 1 micron, for example 0.1 to 0.2 micron.

Generally, the dextrin incorporated into the sheet, or the starch incorporated into the sheet and which in the sheet is subsequently converted to dextrin in the sheet, comprises particles substantially all of which have dimensions within the range 5 to 100 microns. The amounts of dextrin or starch incorporated into the sheet and the particle size thereof will depend on the desired porosity of the diaphragm finally produced. The proportion by weight of dextrin or starch:organic polymeric material may, for example, be in the range 10:1 to 1:10, preferably in the range from 5:1 to 1:1.

The diaphragm suitably has a porosity such that the pores in the diaphragm comprise 50% to 80% of the volume of the diaphragm. The dextrin may be extracted from the sheet by a number of different methods. For example, the sheet may be contacted with a solution of an acid, or with a solution of an alkali, e.g. a solution of caustic soda, or with a solution of an alkali metal hypochlorite. The solutions used are suitably aqueous solutions. Thus, the sheet may be immersed in such a solution of acid or alkali or alkali metal hypochlorite for a time sufficient to extract the dextrin and produce hydraulic flow through the sheet. The time required to extract the dextrin may be found by experiment and will depend on a number of factors, for example on the amount of dextrin in the sheet and on the particle size of the dextrin, on the thickness of the sheet, and on the concentration of acid, alkali or hypochlorite in the extracting solution. The permeability of the sheet increases as the extraction of dextrin proceeds and completion of the extraction coincides with the attainment of maximum permeability.

It is preferred, especially where the diaphragm is to be used in an electrolytic cell of the filter press type, to mount the sheet in the electrolytic cell and to extract the dextrin from the sheet in situ in the cell.

Where the electrolytic cell is a cell of the tank type the sheet may be assembled on the cathode and the sheet may be immersed in a solution of an acid or of an alkali or in a solution of an alkali metal hypochlorite and the dextrin extracted from the sheet. The cathode, having the porous diaphragm mounted thereon, may then be washed and mounted in a cell, care being taken to ensure that the diaphragm does not dry out as collapse of the pores in the diaphragm may then take place.

As there is a possibility that the wet diaphragm positioned on the cathode may be damaged when the cathode is placed in the electrolytic cell it is preferred to extract the dextrin from the sheet of organic polymeric material in situ in the electrolytic cell.

The electrolytic cell will be equipped with an anode and a cathode and the sheet is so positioned in the cell as to divide the cell into anode and cathode compartments.

The in situ extraction of the dextrin from the sheet of organic polymeric material may be effected by filling the electrolytic cell with caustic alkali solution, e.g. caustic soda solution. However use of such a solution may lead to difficulties where the anode in the cell is made of a film-forming metal having a surface coating of an electrocatalytically active coating, as used for example in a cell for the electrolysis of aqueous alkali metal chloride solution, as the coating may be attacked by the caustic alkali solution. Filling the electrolytic cell with a solution of an acid also suffers from a disadvantage in that the acid may attack the cathode, especially where the cathode is made of mild steel.

The dextrin may be extracted from the sheet by filling the cell with an electrolyte, for example, an aqueous solution of an akali metal chloride, and switching on the current to commence electrolysis of the solution.

However, extraction of dextrin from the sheet by electrolysis may take an undesirably long time and is suitably used to complete an extraction which has been partially effected by first extracting the sheet with a solution of acid, alkali or alkali metal hypochlorite.

Where the extraction is effected by electrolysis, or is completed by electrolysis following a partial extraction by a solution of acid, alkali or alkali metal hypochlorite, the electrolysis may be carried out, for example, at the normal operating voltage of the cell, in which case the initial current density wil be lower than the normal operating current density, e.g. 0.5 $kA/m^2$ instead of the usual 2 $kA/m^2$ in the electrolysis of aqueous alkali metal chloride solution, owing to the greater voltage drop across the unextracted sheet as compared with the extracted porous diaphragm which is eventually produced. Alternatively, the electrolysis may be carried out at the normal current density, e.g. 2 $kA/m^2$ in the electrolysis of aqueous alkali metal chloride solution, in which case the initial voltage will be higher than the usual operating voltage, e.g. 4.0 to 4.5 volts instead of about 3 volts. The electrolysis is preferably carried out at a reduced rate of feed, for example of alkali metal chloride solution to the cell. Suitably, a flow corresponding to 10% to 30%, for example 20%, of the full design rate is maintained, and depleted solution is bled off to maintain a constant head of liquor in the anolyte side of the cell. Under these conditions, chlorine production is maintained during the extraction. In general, a low flow of liquor through the diaphragm is produced initially and there is a slow build-up to full operating efficiency, for example a current efficiency of 96 to 97% at about 9% conversion in the electrolysis of aqueous alkali metal chloride solution.

The electrolysis is preferably carried out by preheating the electrolyte in the cell before applying current to the cell; aqueous sodium chloride solution, for example, may be heated to 50° to 60° C., for example 53° C. to 55° C.

Extraction of the dextrin from the sheet of organic polymeric material by the methods hereinbefore described may take rather a long time due, it is believed, to the difficulties of wetting the sheet by the extracting liquids. We find that the time required to extract the dextrin may be reduced if the extracting liquid contains a surfactant in solution. A preferred type of surfactant is a fluorinated surfactant, especially a surfactant of the type sold under the trade mark "Monflor" by Imperial Chemical Industries Limited as such surfactants are in general chemically resistant to the extracting liquids.

Where the electrolytic cell is to be used for the electrolysis of aqueous alkali metal chloride solution and comprises an anode of a film-forming metal or alloy and a surface coating of an electrocatalytically active material, e.g. a mixture of a platinum group metal oxide and a film-forming metal oxide, and a mild steel cathode, a much preferred method of in situ extraction of dextrin from the sheet of organic polymeric material in the electrolytic cell comprises filling the compartment of the cell with a solution of an alkali metal hypochlorite, optionaly containing a surfactant, and filling the cathode compartment of the cell with a solution of a caustic alkali, e.g. caustic soda, as with such solutions there is little if any corrosion of the electrodes. It is preferred to have a head of liquid in the anolyte compartment and to allow the head in this compartment to fall by approximately the volume of the sheet of organic polymeric material and then to maintain the heads of liquid in the anolyte and catholyte compartments at approximately the same level in order to prevent corrosion at the anode and cathode after the sheet has become permeable.

Thereafter the anolyte and catholyte compartments may be drained and the cell filled with an electrolyte, e.g. with an aqueous solution of an alkali metal chloride, and the extraction may be completed by electrolysing the solution.

It may be desirable to incorporate in the sheet of organic polymeric material other components which are not removed from the sheet when it is treated to remove the dextrin. Examples of such components include particulate fillers, especially particulate fillers which confer wettability on the resultant porous diaphragm, that is, which make the diaphragm wettable by the electrolyte to be used in the cell. A particularly suitable filler for this purpose is titanium dioxide. The filler may be incorporated in an aqueous slurry or dispersion of organic polymeric material from which the sheet is produced. Examples of other fillers include barium sulphate, asbestos, e.g. amphibole or serpentine asbestos, graphite and alumina. Suitably, the filler has a particle size of, for example, less than 10 microns, and preferably less than 1 micron. The weight ratio of filler to the organic polymeric material, for example polytetrafluoroethylene, may be for example from 10:1 to 1:10, preferably from 2:1 to 1:2. Alternatively, the filler may be incorporated into the diaphragm by treating the diaphragm produced in the process of the invention with a dispersion of the particulate filler or with a solution of a precursor for the filler which may subsequently be treated to produce the particulate filler.

The diaphragms produced by the process according to the invention are generally strong enough to be used without any support but for extra strength it may be desirable to incorporate in the sheet prior to extraction a suitable strengthening material, for example, a polymer gauze, e.g. a polypropylene gauze or a gauze of a fluoropolymer. For example, a laminate of the sheet and gauze may be formed.

The diaphragm thus produced is particularly suitable for use in electrolytic cells for the electrolysis of aqueous alkali metal chloride solutions to produce chlorine and caustic alkalies.

The invention is illustrated by the following Examples in which all parts and percentages are by weight, and the permeability is defined as:

$$\text{permeability} = \frac{\text{flow rate of catholyte liquor (cm}^2\text{/hr)}}{\text{anolyte head height (cm)} \times \text{area of diaphragm (cm}^2\text{)}}$$

EXAMPLE 1

To 100 parts of an aqueous dispersion of polytetrafluoroethylene containing 60% by weight of polymer in the form of particles substantially all in the size range 0.15 to 0.2 μm were added 100 parts of water, 60 parts of titanium dioxide of particle size substantially 0.2 μm, and 180 parts of potato starch in the form of particles in the size range 10 μm to 50 μm and having a size distribution such that the particle sizes were distributed mainly towards the extremes of the size range. The resultant mixture was then stirred with a paddle-mixer for 30 minutes to form a substantially uniform paste. This paste was spread on trays and dried at 24° C. for 48 hours to a water content of 3.5% by weight. 100 parts of the resultant crumb were mixed with 55 parts of water to form a dough having viscosity of $4\times10^6$ poise. The dough was then spread along the shortest edge of a rectangular piece of card and calendered on the card into the form of a sheet between dual even-speed calender rolls set 3 mm apart. After calendering the sheet was cut in the direction of calendering into four equal pieces. The pieces were laid on the card congruently over each other to obtain a four layered laminate. The card was picked up, rotated 90° in the horizontal plane, and calendered (directed 90° to the original direction of calendering) again through the 3 mm roll separation. This process, the successive cutting into four, stacking, rotating and calendering was repeated until the composition had been roled a total of seven times. The resultant sheet was cut into four in the direction of calendering, stacked, removed from the card, and calendered, without rotation through 90°, the inter-roll space being reduced by the thickness of the card. After calendering, the sheet was cut into four equal pieces at right angles to the direction of calendering, and the pieces were stacked, rotated through 90°, and calendered again. This process, cutting at right angles to the direction of calendering, stacking, rotating and calendering was repeated until the composition had been rolled a total of fourteen times. The resultant essentially rectangular sheet was then passed through the rolls with its largest side directed at 90° to the direction of calendering, and with the inter-roll space slightly reduced, no cutting, stacking or rotating through 90° being involved. This process was repeated through a gradually reduced inter-roll space, the same edge of the sheet being fed to the rolls on each occasion, until the thickness of the sheet was 1.83 mm. A 22×26 mesh gauze woven of 0.28 mm diameter monofilament polypropylene yarn was placed on top of the sheet and rolled into the sheet by calendering through a slightly reduced inter-roll space. A sample for testing in a small laboratory electrolytic cell was then cut from this sheet.

The sample was heat treated to convert the starch to dextrin by placing the sample in a laboratory oven for 21 hours at 200° C. after first removing the backing gauze. The oven was equipped with a fan extractor system to remove any gaseous decomposition products and to provide a uniform air temperature. The treated sheet was then assembled in an electrolytic cell comprising a flat titanium anode coated with an electrocatalytically active coating of mixed ruthenium and titanium oxides and a mild steel gauze cathode. The anode to cathode gap was 6 mm and the test sample was placed in the cell with a piece of backing gauze between the sample and the cathode. The anolyte and catholyte compartments of the cell were then filled with 5% (w/v) NaOH containing 100 ppm (w/v) of a fluorine-containing surfactant Monflor 51. ("Monflor" is a Registered Trade Mark of Imperial Chemical Industries Limited.) A hydrostatic head of about 30 cm was provided on the anolyte side and the cell was left to stand for 18 hours. During this time the anolyte level fell as the dextrin was leached out of the diaphragm. After this extraction period the cell was drained and then washed out and the cell was filled with a 25% by weight aqueous solution of sodium chloride. The diaphragm was found to have a permeability of 0.079 $hr^{-1}$. The cell was then put on load at 2 $kA/m^2$. The permeability quickly rose to 0.144 $hr^{-1}$ during the next 90 minutes as the cell temperature increased and the remaining dextrin was extracted. During the next 6 hours the permeability of the diaphragm continued to increase slowly but the temperature stopped rising at about 40° C. where it remained during the rest of the experiment. The maximum permeability reached was 0.220 $hr^{-1}$ and the average voltage about 3.5 V. After 4 days on load the permeability was 0.113 $hr^{-1}$ and on average remained at this value for the remaining 51 days for which the electrolysis was conducted. During this period from day 4 to day 51 the permeability fluctuated in the range 0.130 to 0.076 $hr^{-1}$.

By way of comparison the above described procedure was repeated except that the starch-containing sheet was not heated and thus the starch was not converted to dextrin. In this comparative example the maximum permeability of the diaphragm of 0.394 $hr^{-1}$ was reached after 4 days of electrolysis and over 13 days electrolysis the permeability of the diaphragms decreased to 0.110 $hr^{-1}$. During the remaining 55 days over which the electrolysis was conducted the permeability of the diaphragm fluctuated over the range 0.337 to 0.049 $hr^{-1}$.

EXAMPLE 2

The procedure of Example 1 was followed to produce a starch-containing polytetrafluoroethylene dough except that 101 parts of water, 60 parts of maize starch having a particle size approximately 13 μm, and 120 parts of potato starch having a particle size less than 75 μm were used, the paste was dried for 72 hours at 27° C. to a water content of 7.5% by weight, and 100 parts of crumb were mixed with 52 parts of water to produce a dough having a viscosity of $4\times10^6$ poise.

A sheet was produced following the calendering procedure of Example 1 except that the procedure of cutting the sheet in the direction of calendering was performed a total of six times, the procedure of cutting the sheet at right angles to the direction of calendering was performed a total of twelve times, and the sheet finally produced had a thickness of 1.80 mm.

A test piece cut from the sheet was immersed in 1% (w/v) HCl for 10 minutes and then placed in an oven as used in Example 1 at 120° C. for 4 hours to convert the starch to dextrin. The sheet was supported in the central zone of the oven so that it did not rest on any hot surfaces.

The treated sheet was then assembled into an electrolytic cell as used in Example 1. The anode to cathode gap was 6 mm and the test sample was placed in the cell with its backing gauze facing the cathode and the additional gauze used in Example 1 was omitted. The anolyte compartment was then filled with 5% (w/v) sodium hypochlorite solution containing 100 ppm (w/v) Monflor 51 to a level of 30 cm above the catholyte outlet. The catholyte compatment was filled with 10% (w/v) NaOH solution. After six hours the anolyte level had fallen slightly and the anolyte compartment was then drained until there was no hydrostatic head across the diaphragm. The cell was then left for 18 hours during which no temperature rise was observed. It was then drained, washed out and filled with a 25% by weight aqueous sodium chloride solution and put on load at 2 $kA/m^2$. At the time of applying the load some flow was observable and after an hour the permeability was 0.094 $hr^{-1}$. During this time the voltage fell from 3.72 V to 3.36 V and the temperature rose to 50° C. The voltage remained in the range 3.36 V to 3.46 V and the temperature at approximately 50° C. The permeability rose to a maximum of 0.133 $hr^{-1}$ after about 4.5 hours on load. During the next 98 days the permeability of the diaphragm was on average 0.103 $hr^{-1}$ and fluctuated over the range 0.113 to 0.046 $hr^{-1}$.

EXAMPLE 3

The procedure of Example 1 was followed to produce a starch-containing polytetrafluoroethylene dough except that 60 parts of maize starch of particle size approximately 13 μm and 120 parts of potato starch of particle size less than 75 μm were used, the paste was dried for 72 hours at 27° C. to a water content of 6.1% by weight, and 100 parts of crumb were mixed with 51 parts of water to form a dough having a viscosity of $4\times10^6$ poise.

A sheet was produced following the calendering procedure of Example 1 except that the procedure of cutting the sheet in the direction of calendering was performed a total of five times, the procedure of cutting the sheet at right angles to the direction of calendering was performed a total of nine times, and the sheet finally produced had a thickness of 1.63 mm.

A 22×26 mesh gauze woven of 0.28 mm diameter monofilament tetrafluoroethylene-hexafluoropropylene copolymer was placed on top of the sheet and rolled into the sheet by calendering through a slightly reduced inter-roll space. A sample for testing in a small laboratory electrolytic cell was then cut from the sheet.

The sample was placed in an oven as used in Example 1 and heated at 120° C. for 120 hours to convert the starch to dextrin and the treated sheet was then assembled in an electrolytic cell as used in Example 1. The anode to cathode gap was 6 mm, the test sample was placed in the cell with its backing gauze facing the cathode, and the additional gauze used in Example 1 was omitted. The anolyte and catholyte compartment of the cell were filled with distilled water with the anolyte level about 30 cm above the level of the catholyte outlet. The cell was left for 7 days and then drained and filled with a 25% by weight aqueous sodium chloride solution and put on load at 2 $kA/m^2$.

Initially the diaphragm was impermeable but after one hour the permeability was 0.030 $hr^{-1}$ and the temperature was 41° C. After six hours the permeability was 0.153 $hr^{-1}$ and the temperature was 45° C. During this time the voltage decreased from 4.9 V to 3.9 V. On the next day the permeability was 0.114 $hr^{-1}$, the temperature was 42° C. and the voltage 3.39 V. Thereafter the voltage fluctuated in the range 3.39 V to 3.52 V and the permeability in the range between 0.115 $hr^{-1}$ and 0.057 $hr^{-1}$.

What we claim is:

1. A method of manufacturing a porous diaphragm of an organic polymeric material suitable for use as a diaphragm in an electrolytic cell which method comprises forming a sheet of a mixture of organic fluorine-containing polymeric material and particulate starch, contacting the sheet with dilute acid and thereafter heating the sheet to convert the starch to dextrine, and extracting the dextrin from the sheet.

2. A method as claimed in claim 1 in which the fluorine-containing polymeric material is polytetrafluoroethylene.

3. A method as claimed in claim 1 in which the sheet is heated at a temperature in the range 70° C. to 220° C.

4. A method as claimed in claim 1 in which the particular starch incorporated into the sheet has dimensions within the range 5 to 100 microns.

5. A method as in claim 1 wherein the proportion of starch incorporated into the sheet: organic polymeric material is in the range 10:1 to 1:10.

6. A method as in claim 1 wherein the proportion of starch incorporated into the sheet: organic polymeric material is in the range 5:1 to 1:1.

* * * * *